United States Patent [19]

Moea

[11] 4,216,787

[45] Aug. 12, 1980

[54] HAIR WAVING ASSEMBLY

[76] Inventor: Victor Moea, 3555 Hyland Blvd., Staten Island, N.Y. 10308

[21] Appl. No.: 947,724

[22] Filed: Oct. 2, 1978

[51] Int. Cl.[2] ..... A45D 2/02

[52] U.S. Cl. ..... 132/39

[58] Field of Search ..... 132/39-44, 132/9; 206/577

[56] References Cited

U.S. PATENT DOCUMENTS

| | | | |
|---|---|---|---|
| 2,465,745 | 3/1949 | Orr et al. | 132/41 R |
| 2,510,664 | 6/1950 | Shield | 132/9 |
| 2,558,305 | 6/1951 | Marvin | 132/40 UX |
| 2,860,769 | 11/1958 | Waller | 206/577 |
| 3,572,350 | 3/1971 | Adams et al. | 132/39 |

FOREIGN PATENT DOCUMENTS

| | | | |
|---|---|---|---|
| 332670 | 9/1958 | Switzerland | 132/39 |

*Primary Examiner*—G. E. McNeill
*Attorney, Agent, or Firm*—Edward F. Levy

[57] ABSTRACT

A hair waving assembly for producing waves in women's hair comprises a plurality of cylindrical rollers which are slidably mounted on a pair of rods. The rollers fit frictionally on the rods and are first spaced apart permitting an operator to weave strands of hair sinuously through the rollers and then push the rollers close together, thereby holding the hair in place while hair setting lotions are applied.

10 Claims, 5 Drawing Figures

HAIR WAVING ASSEMBLY

The present invention relates generally to apparatus for producing waves in women's hair and more particularly to apparatus for producing a type of wave known as a body wave, which gives apparent bulk to otherwise straight hair which would normally appear limp.

In the conventional method of producing a body wave in women's hair, strands of hair are rolled around individual tubular, cylindrical, rollers. A U-shaped clip is applied to each of the rollers in order to hold the hair in place. Setting lotion is then applied to the wrapped hair and dry warm air is applied to speed drying. After an appropriate period, each of the clips are removed and the rollers are removed from the hair. Only a thin strand of hair is wrapped around each roller and is spreadout thereon, so that in order to wave an entire head of hair some 30 or 40 rollers often are required. The resulting operation of producing waves is consequently both time consuming and cumbersome.

The prior art includes attempts to improve upon this procedure by providing various types of devices. One such device is shown in U.S. Pat. No. 2,490,124 to R. B. Garvey and includes a series of parallel tubes which are interconnected by flexible webs. In use, a women's hair is placed against the tubes and a set of additional tubes are forced, one each, between adjacent connected tubes, thereby forcing the hair to take on a serpentine shape.

This device is subject to numerous shortcomings included among which is the reliance on a flexible web to retain the hair. After extended use this web tends to lose its resilient properties and does not retain the hair properly. In addition, this device is manufactured with a fixed number of tubes of uniform size. This results in awkwardness when the device must be used for women's hair which is either longer or shorter than can be accommodated conveniently. Also the size of the curl produced by the device can not be varied since it is determined by the size of the tubes.

It is an object of the present invention to overcome the deficiencies of the prior art by providing an apparatus which can efficiently produce a body wave in women's hair.

Another object of the present invention is to provide a hair waving assembly which can easily be adjusted to accommodate hair of any length.

Another object of the present invention is to provide a hair waving assembly which can produce a variety of sizes of hair curls.

Another object of the present invention is to provide a hair waving assembly which can be applied and removed quickly, making it effective for use by professional beauty operators as well as for use at home.

Still another object of the present invention is to provide a hair waving assembly comprising relatively few simple parts which are economical of manufacture, resulting in a relatively low unit cost.

In accordance with the present invention, there is provided a plurality of tubular cylindrical rollers each of which is slidably mounted on a pair of parallel rods which project through holes formed in the cylindrical surface of the rollers. The first of the rods is disposed adjacent to an end of each of the rollers and the second rod is spaced slightly apart from the first end. The rods fit frictionally through the holes and the rollers can be slid on the rods close to and away from each other.

In use, the rollers are spaced apart from each other on the rods and a section of hair having numerous individual strands is threaded sinuously, over the first of the rollers, under the second of the rollers, over the third of the rollers and so on until the entire section of hair has been wound onto the rollers. A semi-cylindrical clip is provided which is applied to the last roller to hold the ends of the strands of hair in place. The rollers are pushed close together thereby holding the hair tightly and an elastic band is placed around all of the rollers and around the semi-cylindrical clip, thereby retaining both the rollers and the clip in position.

The number of rollers employed may be varied to accommodate various lengths of hair, and rollers of different diameter, resulting in curls of different diameter, may be combined on a single pair of rods, as desired.

Additional objects and advantages of the invention will become apparent during the course of the following specification, when taken in connection with the accompanying drawings in which.

Figure 3:
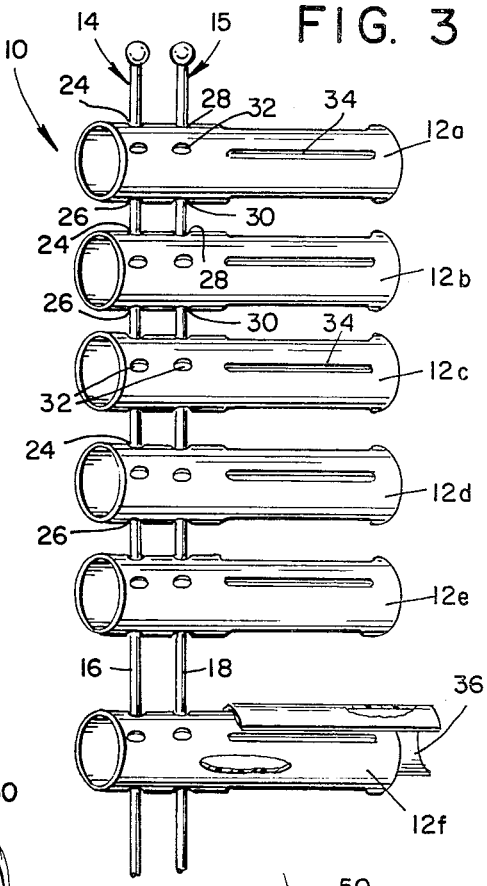
FIG. 3 is an overall perspective view of the hair waving apparatus of the present invention. The rods shown are of uniform diameter and of extended length and are shown broken away for convenience of illustration.

Referring in detail to the drawings, there is shown in FIG. 3 a hair waving assembly 10 made in accordance with the present invention and comprising a plurality of tubular cylindrical rollers 12 which are slidably mounted on a pair of parallel rods 14 and 15. The rollers 12 are preferably made of rigid or semi-rigid plastic material which is impervious to the hair waving and setting lotions to be applied to the hair wrapped on the assembly 10. By way of example, six rollers 12 are shown mounted on rods 14 and 15 in FIGS. 3, 4 and 5. The six rollers are numbered 12*a*, 12*b*, 12*c*, 12*d*, 12*e* and 12*f* for purposes of individual identification.

The rods 14 and 15 are identical and are preferably made of a rigid plastic which may be the same plastic material from which the rollers 12 are formed. The rods 14 and 15 have respective shanks 16 and 18 of circular cross section and uniform diameter, the shanks being of extended length and the lower ends thereof being broken away in the drawings herein, for convenience of illustration. At their upper ends, the shanks 16 and 18 terminate in respective spherical head portions 20 and 22 of increased size.

Figure 4:
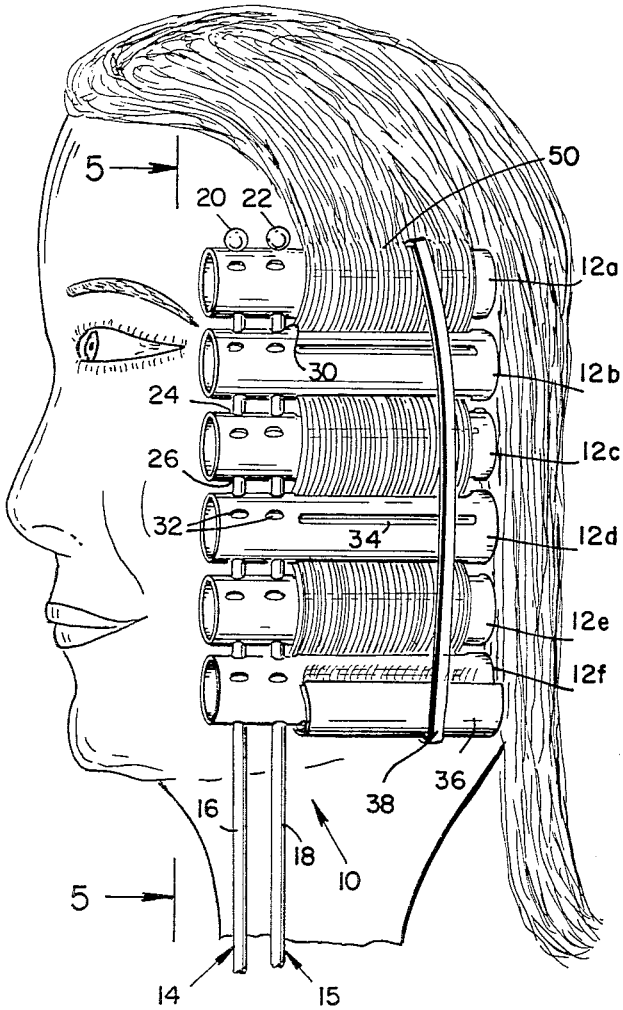
FIG. 4 is a profile view of a women's head showing the hair waving assembly of FIG. 3 in use.

Each of the rollers 12 is formed with a first pair of diametrically-opposed holes 24 and 26 through which the shank 16 of rod 14 projects with a frictional fit. Similarly, the shank 18 of rod 15 projects frictionally through a second pair of holes 28 and 30 formed in each of the rollers 12, the second pair of holes 28 and 30 being aligned with the first pair of holes 24 and 26. When the rollers 12 are mounted on the rods 14, 15, as shown in FIG. 3, the rollers are substantially aligned with each other, forming a vertical array with the rod 14 located proximate to the left end of the rollers 12 and with the other rod 15 extending parallel to the rod 14 and spaced a short distance therefrom. As shown in FIGS. 3 and 4, both rods 14 and 15 are located at one side of the rollers 12, to provide ample space for winding a wide strand of hair around the bodies of the rollers in a manner to be presently described. Since the rod shanks 16 and 18 fit frictionally within the pairs of holes 24, 26 and 28, 30, the rollers 12 may be positioned and set on the rods in the spaced-apart position shown in FIG. 3, or may be pressed close together.

Each of the rollers 12 has a plurality of apertures for the purpose of providing ventilation and reducing weight. The apertures also facilitate the flow of the various setting fluids onto the hair. The apertures may take the form of a plurality of holes such as the holes 32 or a plurality of slots such as the slot 34, or a combination of slots 34 and holes 32 as indicated in FIG. 3.

The hair waving assembly 10 also includes a semi-cylindrical sleeve 36 which is made of a relatively thin material so as to have a degree of flexibility. The sleeve 36 is snap-fitted over a portion of the lowermost roller 12*f*, and is used to secure the ends of the hair by pressing the ends of the hair against the roller 12*f*. The sleeve 36 is secured to the roller by means of an elastic band 38 which encircles all of the rollers 12.

Figure 1:
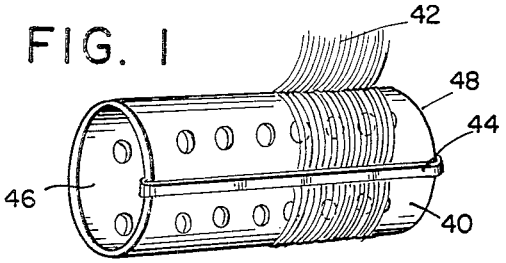
FIG. 1 is a perspective view of a conventional roller showing the manner in which a single strand of women's hair is wound and held thereon.
Figure 2:
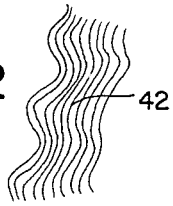
FIG. 2 is a fragmentary perspective view of the strand of women's hair after treatment by the hair waving apparatus of the present invention, showing the hair having a wavy form known customarily as a body wave.

The operation of the hair waving assembly 10 according to the present invention will now be described and contrasted with the operation of conventional hair rollers, one of which, is shown in FIG. 1. When a conventional hair roller 40 is used, individual strands of hair 42 are wound around the roller 40 and the ends of the hair are secured by means of a clip 44 which engages the ends 46, 48 of the roller 40. In order to wave an entire head of hair, a large number of rollers and clips similar to the roller 40 and clip 44 are employed. After the hair is wound on the rollers 40, appropriate setting lotions are applied to the hair, and the hair is then dried and the clips and rollers are removed. If a single strand of hair is wound successively about a row of the rollers 40, the strand of hair 42 will assume the serpentine or sinuous shape shown in FIG. 2. The large number of rollers and clips required for this procedure results in the expenditure of a significant amount of time and effort.

In contrast, when the assembly 10 according to the present invention is used, the rollers 12 are first spaced slightly apart from each other as shown in FIG. 3. The operator grasps a tress or wide section of hair 50 comprising a large number of strands and sinuously weaves it between the rollers, over the first roller 12*a*, under the second roller 12*b*, over the third roller 12*c* and so on until the entire section of hair 50 is wound onto the rollers 12. Although six rollers have been shown in FIG. 3, this has been done by way of example only; additional rollers 12 may be added to the rods 14 and 15 to accommodate longer strands of hair on rollers may be easily removed to accommodate shorter strands of hair.

Figure 5:
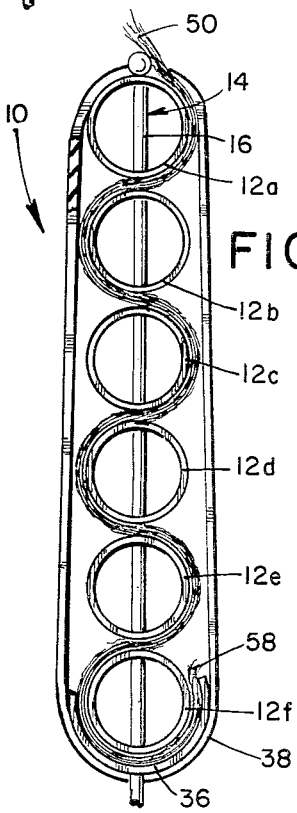
FIG. 5 is an end view of the hair waving assembly of FIG. 3, taken along the line 5—5 of FIG. 4, and drawn to an enlarged scale.

After the entire section of hair 50 has been wound onto the rollers 12, the sleeve 36 is mounted upon the last roller 12*f* and clamped against the end portion of the hair section 50 to secure the end 58 of the hair. The rollers 12 are then pushed together as is shown in FIGS. 4 and 5 and an elastic band 38 is placed around the row of rollers 12 to hold the rollers tightly pressed toward each other to grip the hair section 50 therebetween, and also to further secure the sleeve 36 upon the roller 12*f*. When the rollers are pushed together, they may be brought close to the top ends of the rods 14 and 15, as shown in FIGS. 4 and 5, the enlarged head portions 20 and 22 acting as stops to prevent the uppermost roller 12*a* from slipping off the rods.

Appropriate hair setting lotions and chemicals are then applied to the hair. These lotions may be of a type known in the beauty products industry as permanent waving lotions or, as desired, water may be used for a temporary wave. After the appropriate time for the action of the hair setting lotion and the drying of the hair has elapsed, the elastic band 38 is removed and the rollers 12 are pulled apart from each other so that the assembly 10 may be slipped off the hair.

Alternative forms of operation of the hair waving assembly 10 according to the present invention include weaving the strands of hair over two or more adjacent rollers to form waves of various depths and configurations.

In another mode of operation, the hair may be laid flat on the apparatus 10 and instead of being wound between the rollers 12 as described above, conventional clips such as the clip 44 may be used to clip portions of the hair to the rollers. This generally results in a sharper wave having less depth.

In an alternative embodiment of the invention, rollers of various diameters are combined on the same pair of rods resulting in curls of various sizes and depths. In still other embodiments of the invention, rollers having other than circular cross section, such as square, triangular, rectangular or oval may be employed to achieve special effects.

While preferred embodiments of the invention have been shown and described herein, it is obvious that numerous additions, changes and omissions may be made in such embodiments without departing from the spirit and scope of the invention.

What is claimed is:

1. A hair waving assembly comprising at least one elongated rod, a plurality of tubular hair rollers, and means mounting each of said rollers at one end portion thereof on said rod for sliding movement thereon with said rollers disposed parallel to each other and their end edges aligned with each other, said rod being located adjacent to the aligned edges at one end of said rollers with a major portion of each roller extending perpendicularly from said rod and being unobstructed for the wrapping of a tress of hair thereabout, said mounting means providing a frictional fit for said rollers on said rod, whereby said rollers may be moved along said rod between a first position in which said rollers are spaced apart, and a second position in which said rollers are pressed close together.

2. A hair waving assembly according to claim 1 in which each of said rollers is hollow and is formed with a pair of diametrically-opposed apertures, said rod extending frictionally through said pair of apertures.

3. A hair waving assembly according to claim 1 which comprises a pair of closely-spaced, parallel rods mounting said rollers at said one end portion thereof.

4. A hair waving assembly according to claim 3 in which said rollers comprise hollow cylinders.

5. A hair waving assembly according to claim 4 in which each of said rollers is formed with a first pair of diametrically-opposed apertures and a second pair of diametrically-opposed apertures spaced from said first pair and aligned therewith, said rods extending frictionally through the respective pairs of apertures.

6. A hair waving assembly according to claim 5 which also includes a thin semi-cylindrical sleeve member sized to fit snugly over one of said rollers and covering at least half the surface thereof.

7. A hair waving assembly according to claim 6 in which said sleeve member has sufficient flexibility to be snap-fitted upon said roller.

8. A hair waving assembly according to claim 6 which also includes an elastic band sized to encircle said plurality of rollers and said sleeve member, with said elastic band urging said rollers toward each other and urging said sleeve member to bear against said one roller.

9. A hair waving assembly according to claim 5 in which said plurality of rollers include rollers of various diameters.

10. A hair waving assembly according to claim 3 in which said plurality of rollers include rollers having non-circular cross-sections.

* * * * *